US010788039B2

(12) United States Patent
Fujiwara

(10) Patent No.: US 10,788,039 B2
(45) Date of Patent: Sep. 29, 2020

(54) OIL-COOLED SCREW COMPRESSOR AND CONTROL METHOD THEREFOR

(71) Applicant: Kobe Steel, Ltd., Hyogo (JP)

(72) Inventor: Yuichi Fujiwara, Hyogo (JP)

(73) Assignee: Kobe Steel, Ltd., Hyogo (JP)

( * ) Notice: Subject to any disclaimer, the term of this patent is extended or adjusted under 35 U.S.C. 154(b) by 363 days.

(21) Appl. No.: 15/750,142

(22) PCT Filed: Jul. 21, 2016

(86) PCT No.: PCT/JP2016/071408
§ 371 (c)(1),
(2) Date: Feb. 2, 2018

(87) PCT Pub. No.: WO2017/029937
PCT Pub. Date: Feb. 23, 2017

(65) Prior Publication Data

US 2018/0223847 A1 Aug. 9, 2018

(30) Foreign Application Priority Data

Aug. 14, 2015 (JP) ..... 2015-160052

(51) Int. Cl.
*F04C 28/24* (2006.01)
*F04C 18/16* (2006.01)
(Continued)

(52) U.S. Cl.
CPC ..... *F04C 28/24* (2013.01); *F04B 39/16* (2013.01); *F04C 18/16* (2013.01); *F04C 28/08* (2013.01);
(Continued)

(58) Field of Classification Search
CPC .... F04C 18/16; F04C 28/08; F04C 28/24–26; F04C 29/0007; F04C 29/026; F04C 29/04; F04C 29/042; F04B 39/16
(Continued)

(56) References Cited

U.S. PATENT DOCUMENTS 8,491,280 B2 * 7/2013 Kameya ..... F04C 18/16 417/228
2007/0140866 A1 * 6/2007 Tanaka ..... F04C 28/06 417/26
2011/0110795 A1 5/2011 Van Campfort et al.

FOREIGN PATENT DOCUMENTS

EP 2 703 646 A2 3/2014
JP H09287580 * 11/1997
(Continued)

OTHER PUBLICATIONS

International Search Report issued in PCT/JP2016/071408; dated Oct. 18, 2016.

*Primary Examiner* — Alexander B Comley
(74) *Attorney, Agent, or Firm* — Studebaker & Brackett PC

(57) ABSTRACT

An oil-cooled screw compressor includes a controller having an arithmetic operation section for arithmetically determining a remaining moisture amount Dr from at least a suction temperature Ts, a suction pressure Ps, a discharge temperature Td, and a discharge pressure Pd, an inverter control section for comparing a first rotational speed of a motor at which the remaining moisture amount Dr becomes the target moisture amount and a second rotational speed of the motor at which a discharge pressure Pd becomes the target pressure, and for controlling an inverter so as to drive the motor at the larger one of the first and second rotational speeds, and an air release valve control section for opening an air release valve while the discharge pressure Pd exceeds an air release
(Continued)

pressure when the motor is driven at the first rotational speed.

12 Claims, 7 Drawing Sheets

(51) Int. Cl.

| | |
|---|---|
| ***F04B 39/16*** | (2006.01) |
| ***F04C 29/04*** | (2006.01) |
| ***F04C 28/08*** | (2006.01) |
| ***F04C 29/02*** | (2006.01) |
| ***F04C 28/28*** | (2006.01) |
| ***F04C 29/00*** | (2006.01) |

(52) U.S. Cl.
CPC ..... *F04C 29/026* (2013.01); *F04C 29/04* (2013.01); *F04C 28/28* (2013.01); *F04C 29/0007* (2013.01); *F04C 29/0085* (2013.01)

(58) Field of Classification Search
USPC ..... 418/201.1, 206.8, 201.2, 205; 417/410.4, 417/281, 292, 293, 310
See application file for complete search history.

(56) References Cited

FOREIGN PATENT DOCUMENTS

| | | | | |
|---|---|---|---|---|
| JP | 2004-011426 | A | | 1/2004 |
| JP | 2004-086411 | | * | 1/2004 |
| JP | 2014047652 | A | | 3/2014 |
| JP | 2014222111 | A | | 11/2014 |
| JP | 2015045323 | A | | 3/2015 |

* cited by examiner

OIL-COOLED SCREW COMPRESSOR AND CONTROL METHOD THEREFOR

CROSS-REFERENCE TO RELATED APPLICATIONS

This is a national phase application in the United States of International Patent Application No. PCT/JP2016/071408 with an international filing date of Jul. 21, 2016, which claims priority of Japanese Patent Application No. 2015-160052 filed on Aug. 14, 2015 the contents of which are incorporated herein by reference.

TECHNICAL FIELD

The present invention relates to an oil-cooled screw compressor and a control method therefor.

BACKGROUND ART

There has been known an oil-cooled screw compressor using oil for cooling and lubrication. Air sucked by the oil-cooled screw compressor contains moisture, so that the moisture may be deposited by the compressor and the like. Mixing the deposited moisture with lubricating oil causes a decrease in lubrication function.

JP 2004-11426 A has disclosed an oil-cooled screw compressor in which in order to prevent the above-described deposition of the moisture, a moisture amount accumulated in lubricating oil is arithmetically operated, and when the moisture amount is a predetermined lower value or more, an air release valve (referred to a blowing-off valve as well) is opened to discharge (release) air inside an oil separating and collecting device together with the moisture to outside.

SUMMARY TO THE INVENTION

The oil-cooled screw compressor of JP 2004-11426 A, in which a heat generation amount is small in a low load state where a request pressure is low, easily enters an operation state where the air is released to discharge the moisture, and takes a time to discharge the moisture. Moreover, since the air is released during the state of the moisture discharge operation, a pressure of the oil separating and collecting device decreases. Furthermore, even if the oil-cooled screw compressor enters a high load state where the request pressure is high, the request pressure cannot instantly be supplied because the presser inside the oil separating and collecting device decreases.

Problems to be Solved by the Invention

An object of the present invention is to provide an oil-cooled screw compressor that can prevent moisture from accumulating inside an oil separating and collecting device, and can instantly start to supply a request pressure even if a state changes from a low load state where the request pressure is low to a high load state where the request pressure is high

Means for Solving the Problems

A first aspect of the present invention provides a oil-cooled screw compressor comprising: a compressor body configured to be driven by an electric motor; an inverter configured to change a rotational speed of the electric motor; an oil separating and collecting device fluidly connected to a discharge port of the compressor body; an air release valve fluidly connected to the oil separating and collecting device and configured to release air from the oil separating and collecting device; an arithmetic operation section configured to arithmetically operate to determine a remaining moisture amount, which is a moisture amount that may be mixed with an oil in the oil separating and collecting device; and a controller having an inverter control section and an air release valve control section, the inverter control section being configured to compare a first rotational speed of the electric motor at which the remaining moisture amount becomes a target moisture amount and a second rotational speed of the electric motor at which a discharge pressure becomes a target pressure, and to control the inverter so as to drive the electric motor at larger one of the first rotational speed and the second rotational speed, and the air release valve control section being configured to open the air release valve while the discharge pressure exceeds a predetermined air release pressure set higher than the target pressure when the electric motor is driven at the first rotational speed. The remaining moisture amount is determined from a difference between a moisture amount of a suction air and a moisture amount of a compressed air.

With this structure, the remaining moisture amount can be maintained at the predetermined target moisture amount, and the pressure of the pressed air also can be maintained at the target pressure. As a result, the moisture can be prevented from accumulating inside the oil separating and collecting device, and the request pressure can instantly start to be supplied even if a state changes from a low load state where the request pressure is low to a high load state where the request pressure is high.

It is preferable that the oil-cooled screw compressor further comprises a suction temperature sensor to detect a suction temperature of the compressor body, a suction pressure sensor to detect a suction pressure of the compressor body, a discharge temperature sensor to detect a discharge temperature of the compressor body, and a discharge pressure sensor to detect a discharge pressure of the compressor body, and that the arithmetic operation section arithmetically operates to determine the remaining moisture amount on the basis of at least the suction temperature, the suction pressure, the discharge temperature, and the discharge pressure. The remaining moisture amount is determined from the difference between the moisture amount of the suction air and the moisture amount of the compressed air.

Using the suction pressure sensor, the discharge pressure sensor, the discharge temperature sensor and discharge temperature sensor for arithmetic operation to determine the remaining moisture amount can achieve quantitative calculation of the remaining moisture amount. Accordingly, the remaining moisture amount can be more accurately maintained at the target moisture amount.

It is preferable that the oil-cooled screw compressor further comprises a suction flow rate sensor to detect a suction flow rate of the compressor body, and a suction humidity sensor to detect a suction humidity of the compressor body, and that the arithmetic operation section uses the suction flow rate and the suction humidity for the arithmetic operation to determine the remaining moisture amount.

Using the suction flow rate sensor and the suction moisture sensor for arithmetic operation to determine the remaining moisture amount can achieve more accurate calculation of the remaining moisture.

It is preferable that the oil-cooled screw compressor further comprises a suction valve to adjust a suction air amount of the compressor body, and that the controller further comprises a suction valve control section configured to open the suction valve when the discharge pressure exceeds the predetermined air release pressure.

The operation of the suction valve with the air release valve can more surely prevent an excessive pressure rising in the oil-cooled screw compressor, and can reduce power consumption.

A second aspect of the present invention provides a second aspect of the present invention provides a method of controlling an oil-cooled screw compressor, the method comprising: arithmetically operating to determine a remaining moisture amount, which is a moisture amount that may be mixed with oil in an oil separating and collecting device; calculating a first rotational speed of a compressor at which the remaining moisture amount becomes a target moisture amount; calculating a second rotational speed of the compressor at which a discharge pressure becomes a target pressure; comparing the first rotational speed and the second rotational speed to drive the compressor at the larger one of the first rotational speed and the second rotational speed; and releasing a compressed air of the compressor to an atmosphere while the discharge pressure exceeds a predetermined air release pressure set higher than the target pressure when the compressor is driven at the first rotational speed.

Effect of the Invention

According to the present invention, the remaining moisture amount can be maintained at the predetermined target moisture amount, and the pressure of the oil separating and collecting device 10 can also be maintained at the target pressure. As a result, the moisture can be prevented from accumulating inside the oil separating and collecting device, and the request pressure can instantly start to be supplied even if a state changes from a low load state where the request pressure is low to a high load state where the request pressure is high.

DESCRIPTION OF EMBODIMENTS

Hereinafter, referring to the accompanying drawings, embodiments of the present invention will be described.

First Embodiment

Figure 1:
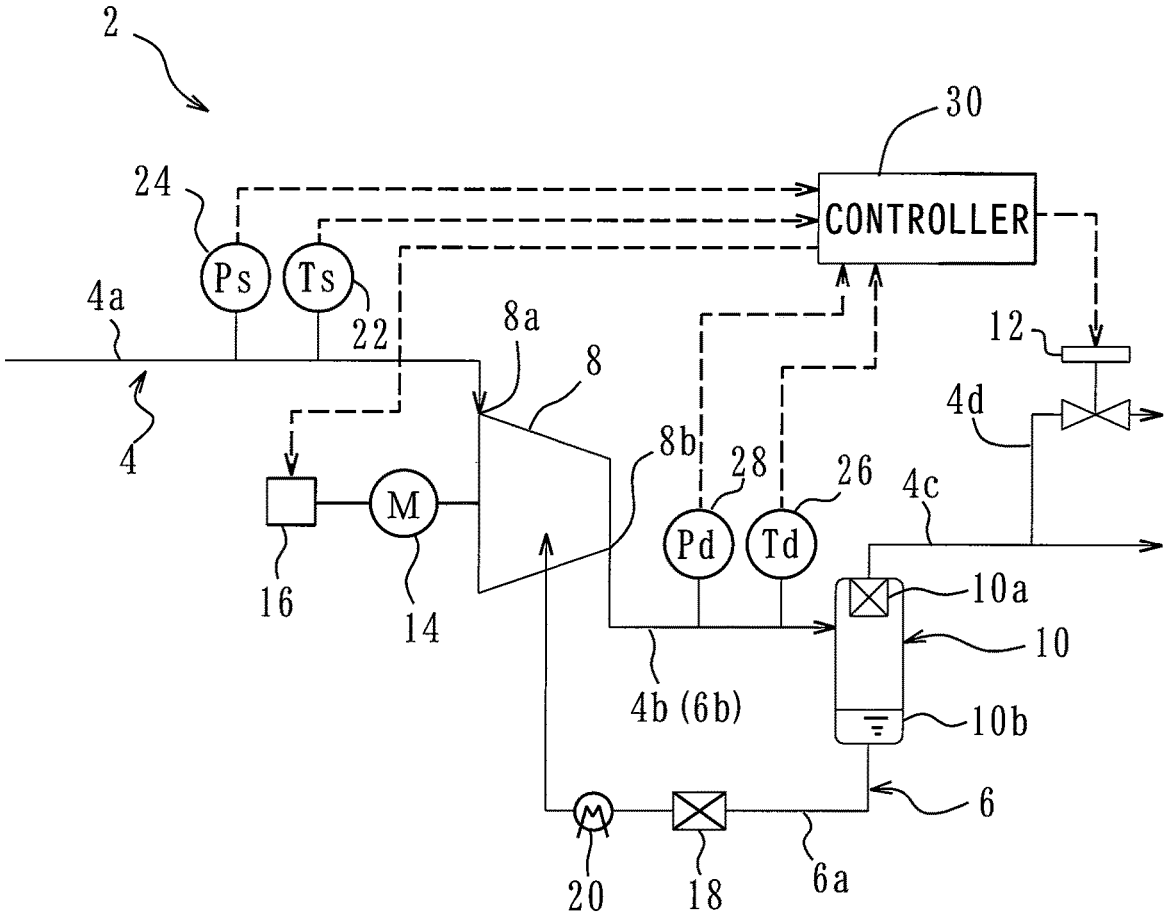
FIG. 1 is a schematic configuration diagram of an oil-cooled screw compressor according to a first embodiment of the present invention.

As shown in FIG. 1, an oil-cooled screw compressor 2 of the present embodiment includes an air passage 4 in which air mainly flows, and an oil passage 6 in which oil used for lubrication and cooling flows.

The air passage 4 is provided with a compressor body 8, an oil separating and collecting device 10, and an air release valve 12.

The compressor body 8 is of an oil-cooled screw type, and sucks air from a suction port 8*a* through first air piping 4*a*. To the compressor body 8 is mechanically connected a motor (an electric motor) 14, and driving the motor 14 allows the air to be compressed by an inside screw not shown. To the motor 14 is electrically connected an inverter 16, so that a rotational speed of the motor 14 can be changed. The compressor body 8 discharges compressed air from a discharge port 8*b* after compression. The discharged compressed air contains a large amount of oil, and is supplied to the oil separating and collecting device 10 through second air piping 4*b*.

The oil separating and collecting device 10 separates the oil and the compressed air. The oil separating and collecting device 10 includes an oil separating element 10*a* disposed in an upper portion, and an oil tank 10*b* disposed in a lower portion. The oil separating element 10*a* separates gas and liquid (the compressed air and the oil). The compressed air, which has passed through the oil separating element 10*a* and been separated from the oil (hereinafter, referred to as discharge air), is supplied to a supply destination through third air piping 4*c*. Fourth air piping 4*d* branches from the middle of the third air piping 4*c*. The fourth air piping 4*d* communicates with the outside through the air release valve 12. Accordingly, adjusting an opening of the air release valve 12 allows the discharge air to the outside through the fourth air piping 4*d*. Moreover, the oil separated in the oil separating element 10*a* is once collected by gravity in the oil tank 10*b* disposed in the lower portion, and the collected oil flows to the oil passage 6.

The oil passage 6 is provided with the compressor body 8, the oil separating and collecting device 10, an oil filter 18, and an oil cooler 20.

The oil collected in the oil tank 10*b* of the oil separating and collecting device 10 is supplied to the compressor body 8 through first oil piping 6*a* to be used for lubrication, cooling, and the like. In the first oil piping 6*a*, the oil filter 18 and the oil cooler 20 are intervened. The oil filter 18 is a filter provided to remove impurities other than the oil. The oil cooler 20 is provided to lower a temperature of the oil. A type of the oil, cooler 20 is not particularly limited, and for example, a heat exchanger may be used. Preferably, using the oil cooler 20 that does not consume electric power can increase efficiency of the oil-cooled screw compressor 2.

The oil used for lubrication and cooling in the compressor body 8 is discharged from the discharge port 8*b* of the compressor body 8 together with the compressed air, and is supplied to the oil separating and collecting device 10 through second oil piping 6*b* (the second air piping 4*b*). In this manner, the oil is supplied in circulation usage.

The first air piping 4*a* is provided with a suction temperature sensor 22 to detect a temperature (hereinafter, referred to as a suction temperature Ts) of the air to be sucked into the compressor body 8 (hereinafter, referred to as suction air), and a suction pressure sensor 24 to detect a pressure of the suction air (hereinafter, referred to as a suction pressure Ps). Moreover, the second air piping 4*b* is provided with a discharge temperature sensor 26 to detect a temperature of the compressed air discharged from the compressor body 8 (hereinafter, referred to as a discharge temperature Td), and a discharge pressure sensor 28 to detect a pressure of the compressed air discharged from the compressor body 8 (hereinafter, referred to as a discharge pressure Pd). The suction temperature sensor 22, the suction pressure sensor 24, the discharge temperature sensor 26, and the discharge pressure sensor 28 output respective measured values to a controller 30.

The controller 30 is constructed by hardware such as a sequencer and the like, and software implemented thereon. The controller 30 controls the inverter 16 and the air release valve 12 on the basis of the measured values of the individual sensors 22 to 28.

Figure 2:
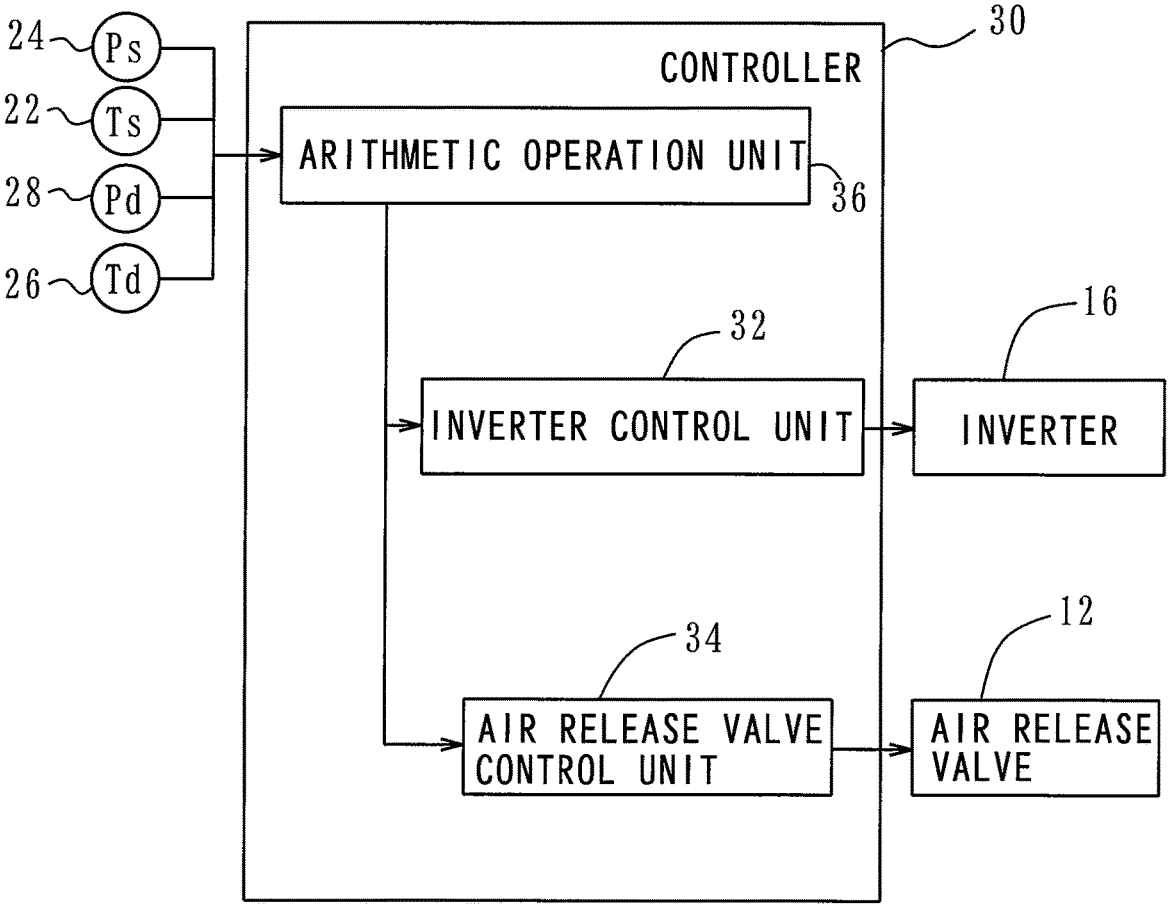
FIG. 2 is a block diagram showing a controller of the oil-cooled screw compressor in FIG. 1.

As shown in FIG. 2, the controller 30 includes an inverter control section 32, an air release valve control section 34, and an arithmetic operation section 36. The inverter control section 32 controls the inverter 16 to adjust the rotational speed of the motor 14. The air release valve control section 34 controls the air release valve 12 to adjust a supply pressure to the supply destination. The arithmetic operation section 36 calculates a remaining moisture amount Dr or an accumulated moisture amount D on the basis of the measured values received from the suction temperature sensor 22, the suction pressure sensor 24, the discharge temperature sensor 26, and the discharge pressure sensor 28, as in formulas (1) to (4).

[Formula 1]

$$Ds=Qs\times(Hs\times Ms/100)/\{Ps-(Hs\times Ms/100)\}\times 18/22.4 \quad (1)$$

[Formula 2]

$$Dd=Qs\times Hd/(Qs\times Hd)\times 18/22.4 \quad (2)$$

[Formula 3]

$$Dr=Ds-Dd \quad (3)$$

[Formula 4]

$$D=\Sigma Dr \quad (4)$$

Here, variables in the foregoing formulas (1) to (4) will be described. A variable Ds represents a moisture amount of the suction air to be sucked into the compressor body 8 from the first air piping 4*a* (hereinafter, referred to as a suction moisture amount). A variable Qs represents a flow rate of the suction air in the first air piping 4*a* (hereinafter, referred to as a suction flow rate amount), and is a value estimated from past data on the basis of the suction temperature Ts and the suction pressure Ps. A variable Hs is a saturation water vapor pressure corresponding to the suction temperature Ts. A variable Ms represents a humidity of the suction air in the first air piping 4*a* (hereinafter, referred to as a suction humidity), and is a value estimated from the past data on the basis of the suction temperature Ts and the suction pressure Ps. A variable Dd represents a moisture amount of the compressed air per unit volume discharged from the compressor body 8 through the second air piping 4*b* (hereinafter, referred to as a discharge moisture amount). A variable Hd is a saturation water vapor pressure corresponding to the discharge temperature Td. A variable Dr is a difference between the suction moisture amount and the discharge moisture amount, and a moisture amount mixed with the oil, in other words, a moisture amount that may be mixed with the oil in the oil separating and collecting device 10 (hereinafter, referred to as a remaining moisture amount). A variable D is an amount resulting from accumulating the moisture amount Dr mixed with the oil (hereinafter, referred to as an accumulated water amount).

Next, referring to FIG. 3, a control flow of the present embodiment will be described. After activation (step S3-1), the oil-cooled screw compressor 2 of the present embodiment controls, by the inverter control section 32, the inverter 16 at a larger one of a first rotational speed and a second rotational speed of the motor 14 (step S3-2). Here, the first rotational speed is a rotational speed of the motor 14 at which the remaining moisture amount Dr becomes a target moisture amount. The target moisture amount may be set, for example, to zero, that is, setting may be made so that no moisture should be mixed with the oil and be substantially accumulated. The second rotational speed is a rotational speed of the motor 14 at which the discharge pressure Pd becomes a target pressure. The target pressure is set in accordance with a request pressure requested from the supply destination.

When the first rotational speed is selected by the inverter control section 32, the rotational speed of the motor 14 is controlled so that the remaining moisture amount Dr follows zero as the target moisture amount of the present embodiment (step S3-3). At this time, it is determined whether or not the discharge pressure Pd is higher than an air release pressure (step S3-4). If the discharge pressure Pd is higher than the air release pressure, the air release valve 12 is opened by the air release valve control section 34 to release the air and reduce the pressure (step S3-5). Otherwise, the air release is not performed. The inverter 16 is again controlled at the larger one of the first rotational speed and the second rotational speed of the motor 14 by the inverter control section 32 (step S3-2), and the foregoing processing is repeated. Here, the air release pressure is a pressure that is set slightly higher than the target pressure in order to prevent frequent opening/closing operation of the air release valve 12 around the target pressure.

When the second rotational speed is selected by the inverter control section 32, control is performed so that the discharge pressure Pd follows the target pressure (step S3-6). In this case, since the discharge pressure never exceeds the target pressure, the air release is not needed. The inverter 16 is again controlled at the larger one of the first rotational speed and the second rotational speed of the motor 14 by the inverter control section 32 (step S3-2), and the foregoing processing is repeated.

In this manner, the remaining moisture amount Dr can be maintained at the predetermined target moisture amount, and the pressure of the oil separating and collecting device 10 can be maintained at the target pressure. As a result, the moisture can be prevented from accumulating inside the oil separating and collecting device 10, and the request pressure can instantly start to be supplied even if a state changes from a low load state where the request pressure is low to a high load state where the request pressure is high.

Second Embodiment

Figure 4:
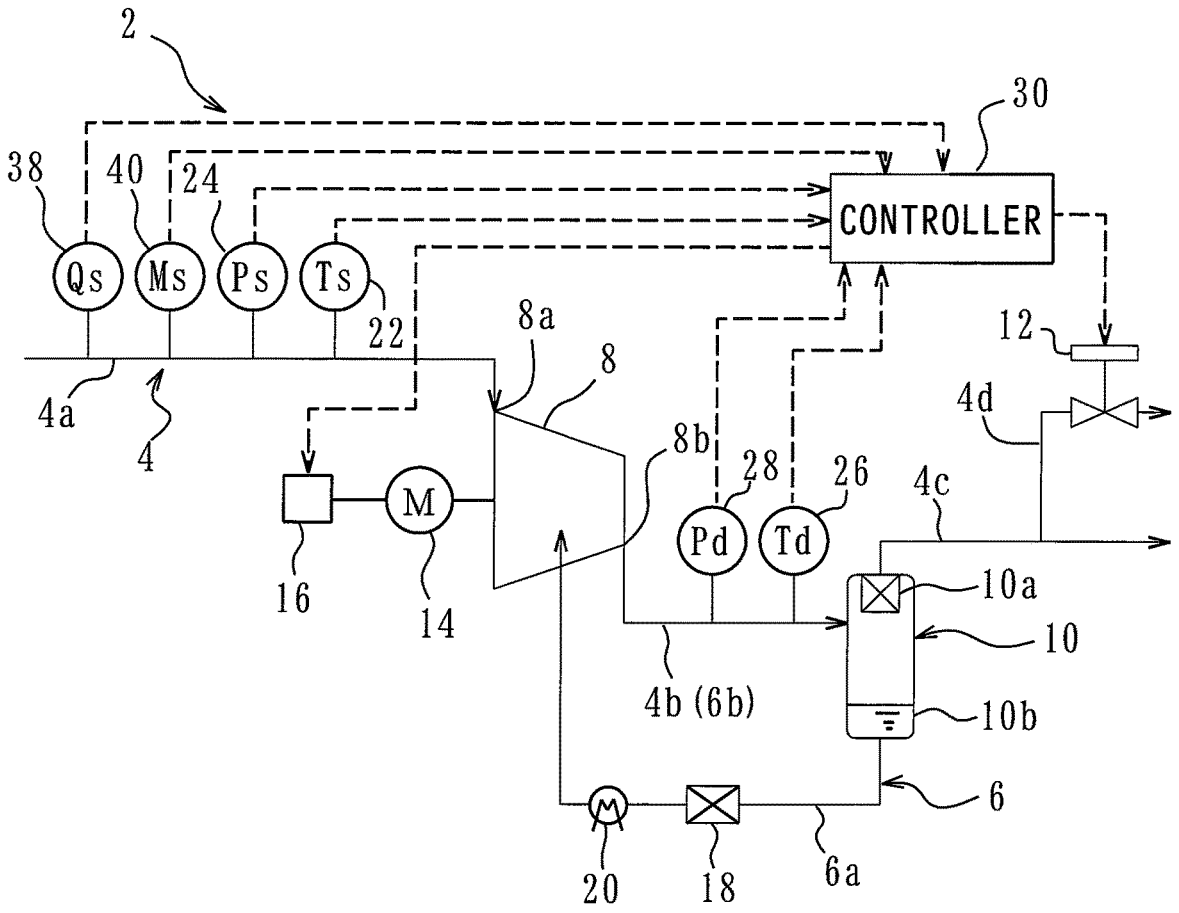
FIG. 4 is a schematic configuration diagram of an oil-cooled screw compressor according to a second embodiment of the present invention.

FIG. 4 shows a schematic configuration diagram of the oil-cooled screw compressor 2 of a second embodiment. The oil-cooled screw compressor 2 of the present embodiment is substantially similar to that of the first embodiment in FIG. 1 except that the first air piping 4*a* is provided with a suction flow rate sensor 38 and a suction humidity sensor 40. Accordingly, descriptions of similar portions to the configurations shown in FIG. 1 will be omitted.

In the present embodiment, the first air piping 4*a* is provided with the suction flow rate sensor 38 to detect the suction flow rate Qs to the compressor body 8, and the suction humidity sensor 40 to detect the suction humidity Ms to the compressor body 8. The suction flow rate sensor 38 and the suction humidity sensor 40 output respective measured values to the controller 30.

Figure 5:
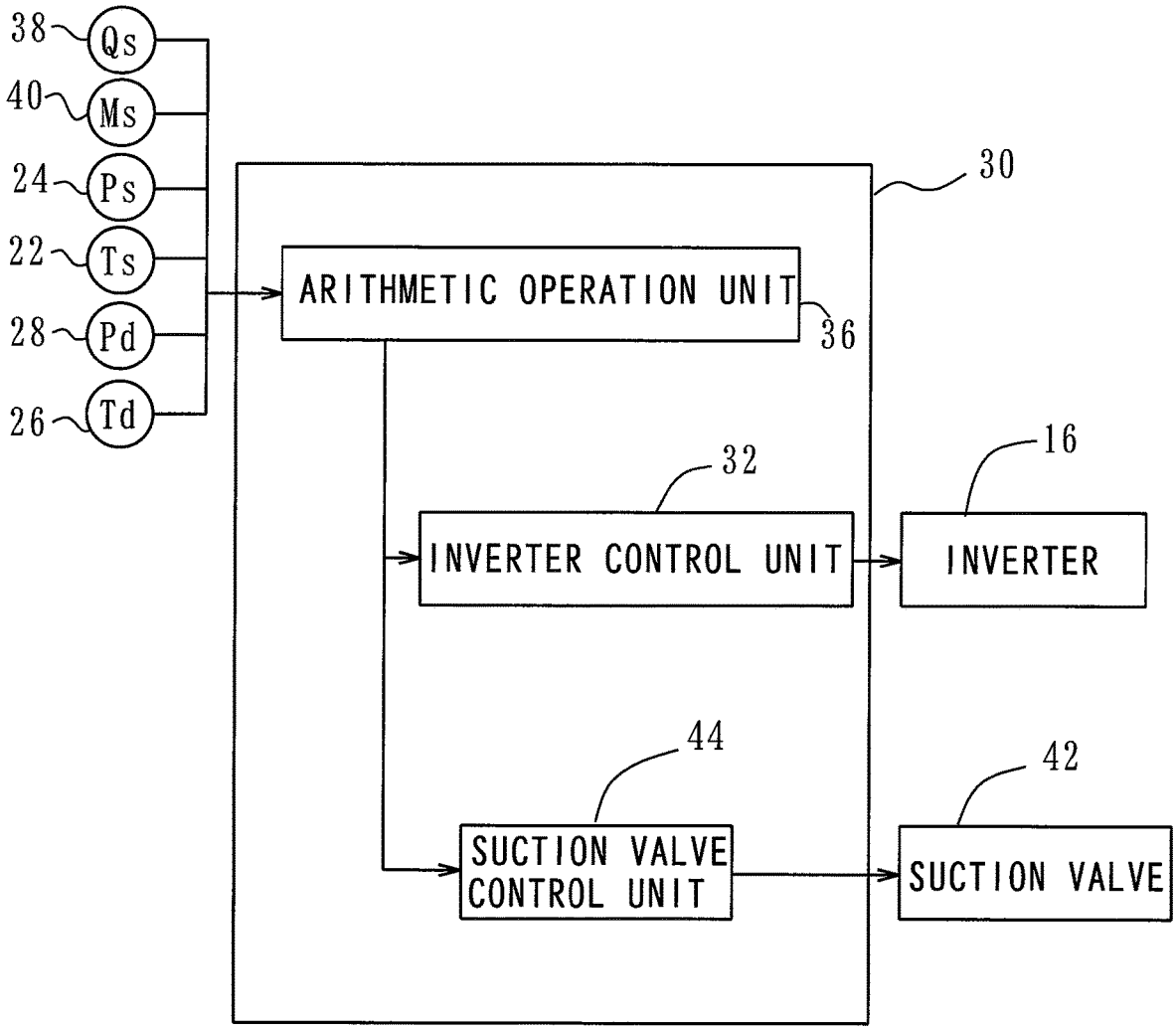
FIG. 5 is a block diagram showing a controller of the oil-cooled screw compressor in FIG. 4.

As shown in FIG. 5, the arithmetic operation section 36 of the present embodiment calculates the remaining moisture amount Dr on the basis of the measured values from the suction flow rate sensor 38, the suction humidity sensor 40, the suction temperature sensor 22, the suction pressure sensor 24, the discharge temperature sensor 26, and the discharge pressure sensor 28, as in the foregoing formulas (1) to (3).

Of the variables in the foregoing formulas (1) to (4), for the suction flow rate Qs and the suction humidity Ms, actual measured values measured by the suction flow rate sensor 38 and the suction humidity sensor 40 are used, unlike the first embodiment. Accordingly, the more precise remaining moisture amount Dr or accumulated moisture amount D can be calculated.

Figure 3:
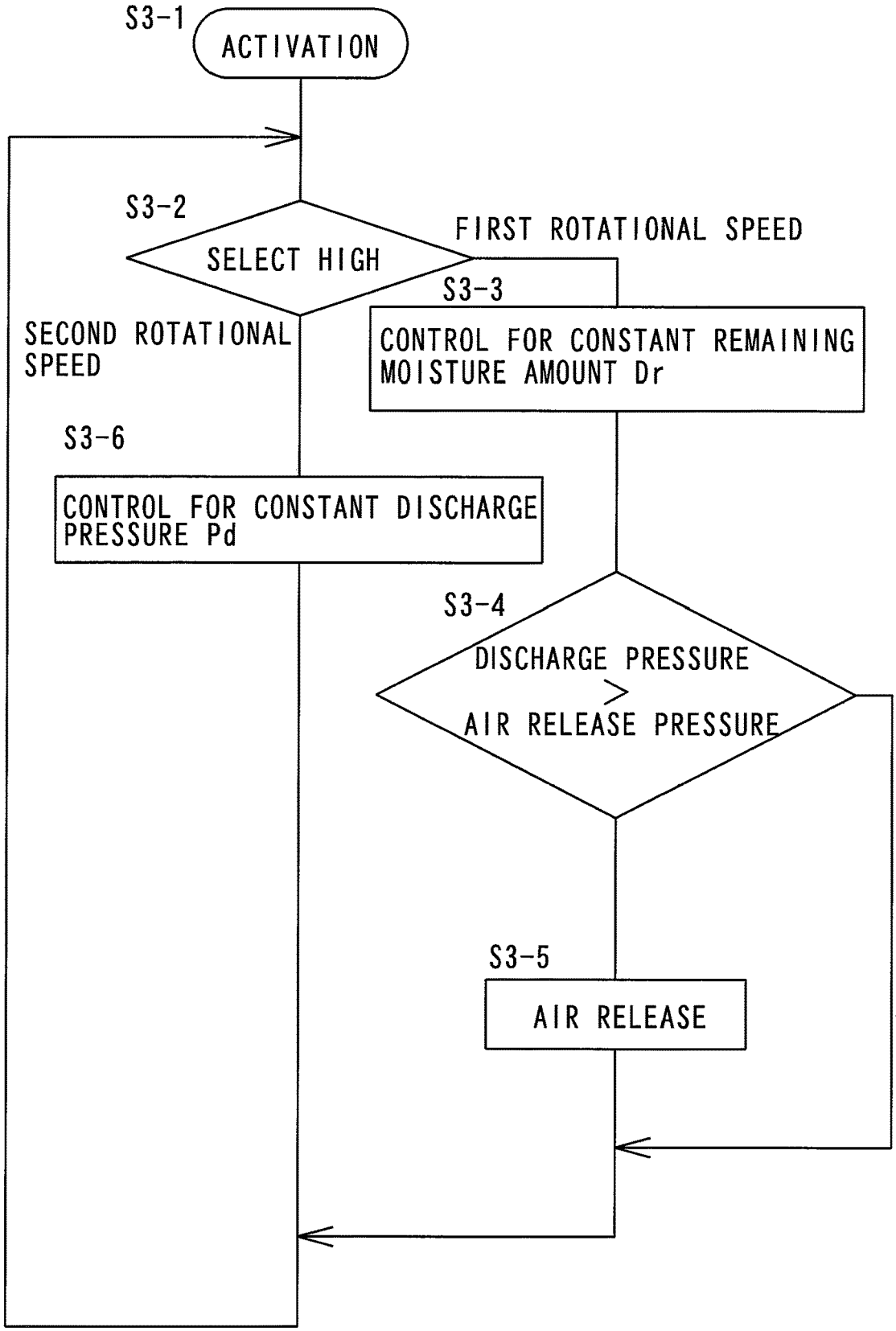
FIG. 3 is a flowchart showing control of the oil-cooled screw compressor in FIG. 1.

A control flow of the present embodiment is the same as the control flow of the first embodiment shown in FIG. 3.

Third Embodiment

Figure 6:
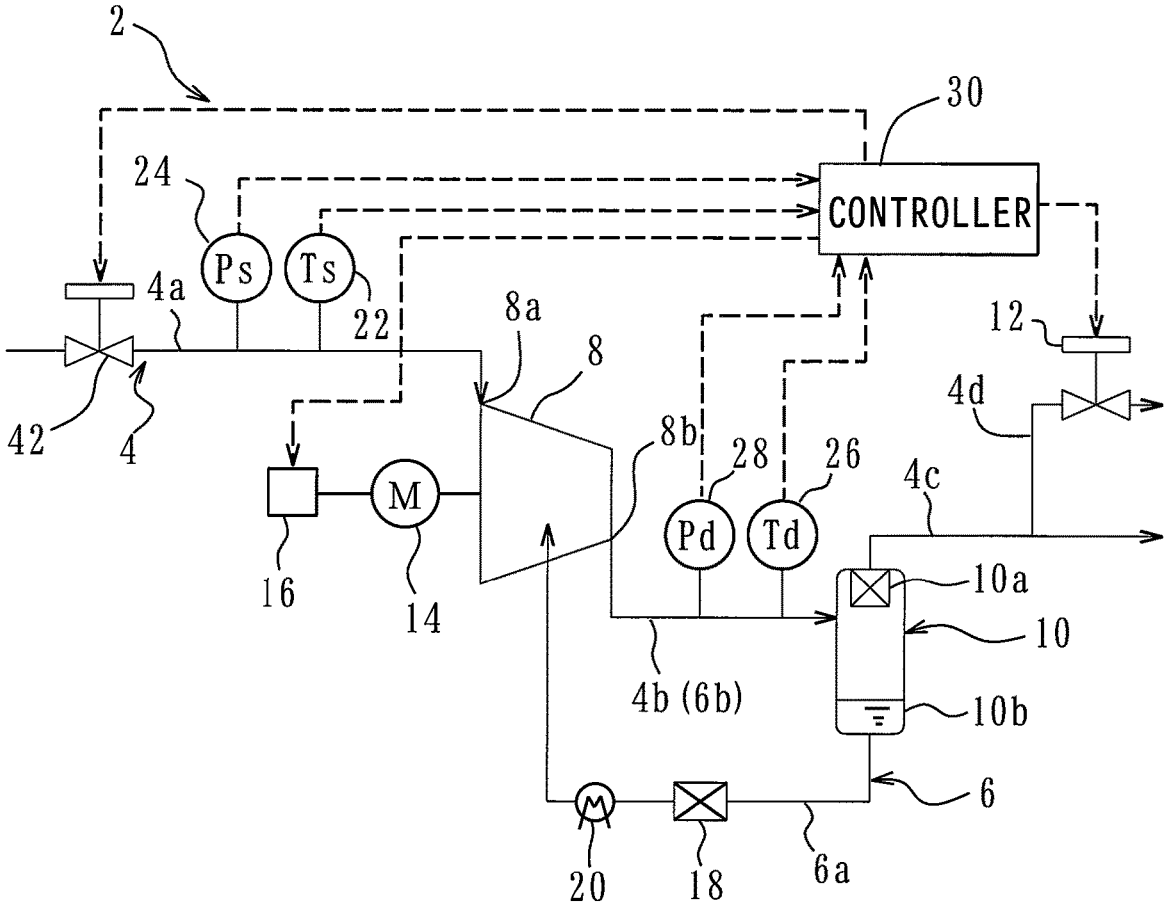
FIG. 6 is a schematic configuration diagram of an oil-cooled screw compressor according to a third embodiment of the present invention.
Figure 7:
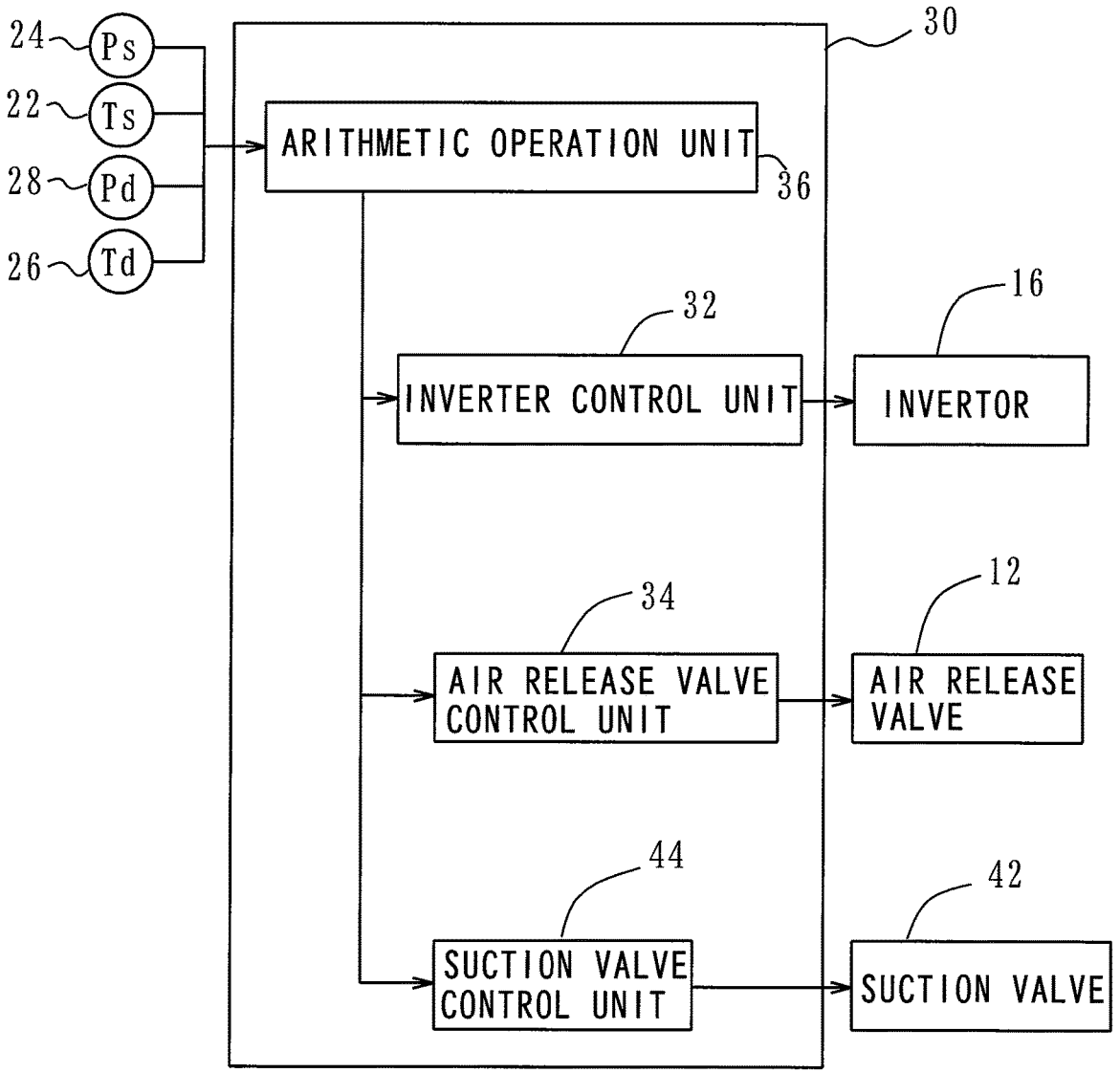
FIG. 7 is a block diagram showing a controller of the oil-cooled screw compressor in FIG. 6.

FIG. 6 is a schematic configuration diagram of the oil-cooled screw compressor 2 of a second embodiment. The oil-cooled screw compressor 2 of the present embodiment is substantially similar to that of the first embodiment in FIG. 1 except that a suction valve 42 is added to the first air piping 4*a*. Accordingly, descriptions of similar portions to the configurations shown in FIG. 1 will be omitted.

In the present embodiment, the first air piping 4*a* is provided with the suction valve 42 to adjust a supply amount of the air to the compressor body 8. Moreover, the controller 30 further includes a suction valve control section configured to control the suction valve 42 so as to close the same when the discharge pressure Pd exceeds a predetermined air release pressure. The air release valve control section 34 of the present embodiment controls the air release valve 12 so as to open the same when the discharge pressure Pd exceeds the predetermined air release pressure.

In the present embodiment, while a control flow is schematically the same as the control flow of the first embodiment shown in FIG. 3, the air release is performed by the air release valve 12 in step S3-5, and at the same time, the suction valve 42 is also closed. In this manner, opening the air release valve 12 and closing the suction valve 42 can more surely prevent abnormal pressure rising in the oil-cooled screw compressor 2, and can reduce power consumption.

While the specific embodiments of this invention have been described, this invention is not limited to the foregoing embodiments, but can be carried out by making various modifications within the scope of this invention. For example, an embodiment obtained by combining the contents described in the foregoing first to third embodiments as needed may be one embodiment of this invention. Moreover, each of the suction temperature sensor 22, the suction pressure sensor 24, the discharge temperature sensor 26, the discharge pressure sensor 28, the suction flow rate sensor 38, and the suction humidity sensor 40 may be each installed at another position where an equivalent measured value can be obtained by each of the sensors in place of any of the air piping 4*a* to 4*d* in the air passage 4.

Moreover, the remaining moisture amount only needs to be a difference between an amount of moisture in gas per 1 $m^3$ sucked by the compressor body 8 (the suction moisture amount) and an amount of moisture accompanying the gas per 1 $m^3$ discharged by the compressor body 8 in a saturation state and flowing out (the discharge moisture amount), and may be found in an arithmetical operation other than the foregoing embodiment. For example, a remaining moisture amount Wr can be found from a difference between a suction moisture amount Ws and a discharge moisture amount Wd found from the following formulas (5) and (6) (Wr=Ws−Wd).

In the case where the suction gas of the compressor body 8 is the suction air, if the suction temperature is Ts (° C.) and the suction humidity is Ms (%), the suction moisture amount Ws (kg/$m^3$) is represented by the following formula.

[Formula 5]

$$Ws=0.622\times1.293\times Hs\div760 \tag{5}$$

Here, Hs(=Ms÷100×Hs') represents a water vapor partial pressure (mmHg), and Hs'(=10^{18.884−2224.4÷(273+Ts)}) represents a saturation water vapor pressure (mmHg). However, "10^X" means an X-th power of 10 (=$10^X$).

Next, if the pressure of the compressed air, that is, the discharge pressure is Pd (kg/$cm^2$G), and the temperature of the compressed air, that is, the discharge temperature is Td(° C.), the discharge moisture amount Wd (kg/$m^3$) is represented by the following formula.

[Formula 6]

$$Wd=0.622\times1.293\times Hd\div\{760\div1.033\times(1.033+Pd)\} \tag{6}$$

Here, Hd(=100÷100×Hd'=Hd') represents a water vapor partial pressure (mmHg), and Hd'(=10^{8.884−2224.4÷(273+Td)}) represents a saturation water vapor pressure (mmHg).

The invention claimed is:

1. An oil-cooled screw compressor comprising:

a compressor body configured to be driven by an electric motor;

an inverter configured to change a rotational speed of the electric motor;

an oil separating and collecting device fluidly connected to a discharge port of the compressor body;

an air release valve fluidly connected to the oil separating and collecting device and configured to release air from the oil separating and collecting device;

an arithmetic operation section configured to arithmetically operate to determine a remaining moisture amount, which is a moisture amount mixed with an oil in the oil separating and collecting device; and a controller having an inverter control section and an air release valve control section, the inverter control section being configured to compare a first rotational speed of the electric motor at which the remaining moisture amount becomes a target moisture amount and a second rotational speed of the electric motor at which a discharge pressure becomes a target pressure, and to control the inverter so as to drive the electric motor at the larger of the first rotational speed and the second rotational speed, and the air release valve control section being configured to open the air release valve while the discharge pressure exceeds a predetermined air release pressure set higher than the target pressure when the electric motor is driven at the first rotational speed.

2. The oil-cooled screw compressor according to claim 1, further comprising:

a suction temperature sensor to detect a suction temperature of the compressor body;

a suction pressure sensor to detect a suction pressure of the compressor body;

a discharge temperature sensor to detect a discharge temperature of the compressor body; and a discharge pressure sensor to detect a discharge pressure of the compressor body, wherein the arithmetic operation section arithmetically operates to determine the remaining moisture amount on the basis of at least the suction temperature, the suction pressure, the discharge temperature, and the discharge pressure.

3. The oil-cooled screw compressor according to claim 2, wherein the remaining moisture amount is determined from a difference between a moisture amount of a suction air and a moisture amount of a compressed air.

4. The oil-cooled screw compressor according to claim 2, further comprising:

a suction flow rate sensor to detect a suction flow rate of the compressor body; and a suction humidity sensor to detect a suction humidity of the compressor body, wherein the arithmetic operation section uses the suction flow rate and the suction humidity for the arithmetic operation to determine the remaining moisture amount.

5. The oil-cooled screw compressor according to claim 2, further comprising a suction valve to adjust a suction air amount of the compressor body, wherein the controller further comprises a suction valve control section configured to open the suction valve when the discharge pressure exceeds the predetermined air release pressure.

6. The oil-cooled screw compressor according to claim 1, wherein the remaining moisture amount is determined from a difference between a moisture amount of a suction air and a moisture amount of a compressed air.

7. The oil-cooled screw compressor according to claim 1, further comprising:

a suction flow rate sensor to detect a suction flow rate of the compressor body; and a suction humidity sensor to detect a suction humidity of the compressor body, wherein the arithmetic operation section uses the suction flow rate and the suction humidity for the arithmetic operation to determine the remaining moisture amount.

8. The oil-cooled screw compressor according to claim 1, further comprising a suction valve to adjust a suction air amount of the compressor body, wherein the controller further comprises a suction valve control section configured to open the suction valve when the discharge pressure exceeds the predetermined air release pressure.

9. A method of controlling an oil-cooled screw compressor, the method comprising:

arithmetically operating to determine a remaining moisture amount, which is a moisture amount mixed with oil in an oil separating and collecting device;

calculating a first rotational speed of a compressor at which the remaining moisture amount becomes a target moisture amount;

calculating a second rotational speed of the compressor at which a discharge pressure becomes a target pressure;

comparing the first rotational speed and the second rotational speed to drive the compressor at the larger of the first rotational speed and the second rotational speed; and releasing a compressed air of the compressor to an atmosphere while the discharge pressure exceeds a predetermined air release pressure set higher than the target pressure when the compressor is driven at the first rotational speed.

10. The method of controlling the oil-cooled screw compressor according to claim 9, wherein the arithmetical operation of the remaining moisture amount is performed on the basis of at least a suction temperature, a suction pressure, a discharge temperature, and a discharge pressure.

11. The method of controlling the oil-cooled screw compressor according to claim 10, wherein the remaining moisture amount is determined from a difference between a moisture amount of a suction air and a moisture amount of the compressed air.

12. The method of controlling the oil-cooled screw compressor according to claim 9, wherein the remaining moisture amount is determined from a difference between a moisture amount of a suction air and a moisture amount of the compressed air.

* * * * *